United States Patent [19]

Krüger et al.

[11] Patent Number: 4,626,319

[45] Date of Patent: Dec. 2, 1986

[54] PROCESS FOR THE DELIGNIFICATION AND ACID BLEACHING OF CELLULOSE WITH OXYGEN AND HYDROGEN PEROXIDE

[75] Inventors: Horst Krüger, Darmstadt; Hans-Ulrich Süss, Hasselroth, both of Fed. Rep. of Germany; Gerhard Arnold, Mobile, Ala.; Sigrid Anspach, Grosskarlbach, Fed. Rep. of Germany; Ursula Schwartzkopff, Kleinostheim, Fed. Rep. of Germany; Hans Jelitto, Lampertheim, Fed. Rep. of Germany

[73] Assignee: Degussa Aktiengesellschaft, Frankfurt am Main, Fed. Rep. of Germany

[21] Appl. No.: 757,242

[22] Filed: Jul. 22, 1985

[30] Foreign Application Priority Data

Aug. 1, 1984 [DE] Fed. Rep. of Germany ..... 3428352

[51] Int. Cl.[4] ..... D21C 9/16

[52] U.S. Cl. ..... 162/65; 162/76; 162/78

[58] Field of Search ..... 162/84, 76, 78, 65, 162/19; 8/111

[56] References Cited

U.S. PATENT DOCUMENTS

| | | | |
|---|---|---|---|
| 3,719,552 | 3/1973 | Farley et al. | 162/65 |
| 3,759,783 | 9/1973 | Samuelson et al. | 162/65 |
| 4,222,819 | 9/1980 | Fossum | 162/78 |
| 4,372,812 | 2/1983 | Phillips | 162/40 |
| 4,410,397 | 10/1983 | Kempf | 162/78 |
| 4,427,490 | 1/1984 | Eckert | 162/78 |

FOREIGN PATENT DOCUMENTS 7900637 9/1969 PCT Int'l Appl. .

OTHER PUBLICATIONS

Krüger et al; "Oxygen/Peroxide Bleaching of Sulphite Pulp", Pulp & Paper Canada; 12–1984, p. 109; presented 10(20–22) 1984, Toronto, Canada.

*Primary Examiner*—Steve Alvo

*Attorney, Agent, or Firm*—Cushman, Darby & Cushman

[57] ABSTRACT

A process for the delignification and bleaching of cellulose with oxygen and hydrogen peroxide, in which in a given case the delignification is carried out with oxygen in the presence of MgO, and the cellulose subsequently is bleached simultaneously with hydrogen peroxide and oxygen at a pH<5.

22 Claims, No Drawings

PROCESS FOR THE DELIGNIFICATION AND ACID BLEACHING OF CELLULOSE WITH OXYGEN AND HYDROGEN PEROXIDE

BACKGROUND OF THE INVENTION

The invention is directed to the delignification of cellulose with oxygen and hydrogen peroxide in acid medium.

Cellulose obtained in a chemical way, such as, e.g., from the sulfite process or which is obtained by the alkaline soda or sulfate process in addition to the main constituent cellulose also contains small amounts of lignin, hemicellulose, and several other constituents. The materials mentioned which accompany cellulose, above all lignin, cause the coloration of the cellulose or products produced therefrom.

In order to produce paper or other products of a high degree of whiteness which are not inclined to yellow from the cellulose, it is necessary to remove by bleaching the accompanying materials remaining after the chemical treatment.

According to the state of the art, the bleaching is carried out in multistep systems with, e.g., chlorine, hypochlorite, oxygen, and hydrogen peroxide. In using chlorine as well as hypochlorite, it is disadvantageous that chlorinated materials are formed which are difficult to break down biologically and in part exhibit mutagenic properties. Vaporization and burning of this waste water is the best method for reducing the waste water problem. The return of the waste water from the bleaching in the chemical purification process of the bleaching of the treatment, however, creates problems because of the corrosion caused by the chloride ions.

Oxygen and hydrogen peroxide today are used exclusively under alkaline conditions as bleaching agent. Therefore, the waste liquor of the bleaching process contains sodium hydroxide liquor and is only returned problem free in a treatment process having sodium as the base. In the production of sulfate cellulose (kraft pulp) in which the processing is with alkaline sulfide solution, this is readily possible. In contrast, the production of sulfite cellulose today is carried out almost exclusively with magnesium or calcium sulfite. In the chemical recovery, a mixture with sodium ions leads to a reduction in melting point in the combustion furnace so that the chemical recovery from the fly ash and/or the degree of efficiency of the plant is disturbed. Therefore, for sulfite cellulose factories based on magnesium, there were developed processes which operate with magnesium oxide as the base. The apparatuses necessary for this purpose, however, are clearly more expensive in comparison to the use of sodium hydroxide liquor, since higher pressures and higher temperatures are necessary.

Therefore, bleaching agents which neither contain or need chloride ions or cations such as $Na^+$ are desirable for universal use.

This is valid for compounds such as ozone, nitrogen dioxide, and peracetic acid. The bleaching and delignification are carried out with these oxidizing agents under acid conditions so that no cations must be added. In spite of this, previously for economical reasons, none of these bleaching agents has penetrated the industry.

Fossum et al U.S. Pat. No. 4,222,819 is directed to the acid delignification with peroxides, preferably hydrogen peroxide. According to this process, there is connected to the acid treatment an alkaline extraction step in order to remove the lignin that has become soluble.

Since immediately after to the acid treatment with hydrogen peroxide there must follow an alkaline treatment with sodium hydroxide liquor, there is eliminated the possibility of a common vaporization of the waste water of the bleaching step with the waste liquor, e.g., of a magnesium sulfite treatment.

There is described in U.S. Pat. No. 4,410,397 and U.S. Pat. No. 4,427,490 the delignification and bleaching of cellulose in acid medium, and there is proposed the addition of metal additives to improve the effect.

However, it does not appear practical to incorporate metal ions into the bleaching process which subsequently will load the waste water.

The task of the invention was to develop a process for the delignification and bleaching of cellulose in which a return of the waste water from the bleaching into the chemical upgrading process is accomplished as free from problems as is possible.

SUMMARY OF THE INVENTION

The invention is directed to a process for the delignification and bleaching of cellulose with oxygen and hydrogen peroxide comprising simultaneously treating the cellulose pulp at a pH $<5$ with hydrogen peroxide and oxygen.

Preferably, there is employed sulfite cellulose which was produced using calcium or magnesium sulfite.

The mixture contains oxygen in an amount of 0.1 to 5 wt.% and 0.1 to 3 wt.% of hydrogen peroxide based on the bone dry cellulose.

The process is carried out at 60° to 120° C., preferably 80° to 100° C., at 2 to 30%, preferably 8 to 15%, pulp density and under an oxygen pressure of 0.03 to 0.5 MPa, preferably at 0.3 MPa.

The most suitable pH range is from 1 to 4, preferably 1.5 to 3.

During the treatment of sulfite cellulose with hydrogen peroxide in acids, only a limited success is brought about and also with oxygen only a trifling amount of delignification is attained, but the combined use of oxygen and hydrogen peroxide leads to a clear reduction of the lignin content.

These favorable results are not obtained with the combination of acid and alkaline treatment described by Fossum et al. The total reduction in Kappa number achieved by separate hydrogen peroxide and oxygen treatments give no hint to the strong breakdown of lignin obtained in the process of the invention.

The process of the invention can comprise, consist essentially of, or consist of the stated steps with the recited materials.

Unless otherwise indicated, all parts and percentages are by weight.

TABLE 1

Delignification of Spruce Sulfite-Cellulose with $O_2$ and $H_2O_2$ (Kappa 18)

| Step | $H_2O_2$ % | $O_2$MPa | pH | Kappa |
|---|---|---|---|---|
| P | 1.0 | — | 1.5 | 13.2 |
| P + E | 1.0 | — | 1.5 + 10.5 | 9.2 (according to Fossum et al) |
| O | — | 0.3 | 1.5 | 16.6 |
| O/P | 1.0 | 0.3 | 1.5 | 7.5 (according to the invention) |

Constant conditions: 14% pulp density 100° C., 60 min.

The waste water from the oxygen/peroxide treatment process can be lead back without problem countercurrent to the cellulose in calcium or magnesium sulfite processes.

If a final bleaching is connected to the acid oxygen/-peroxide treatment a further advantage is that corresponding to the lignin breakdown up to 50% of the total waste water load caused by the bleaching and delignification is formed in the O/P step.

Based on Table 2 in the form of COD values (chemical oxygen demand), there are compared the waste waters of a conventional C-E-H-H sequence and the acid O/P treatment with a connected H-H final bleach.

TABLE 2

Bleaching of Beech Sulfite-Cellulose (Kappa 17.1)

| Bleaching Sequence | Chemicals | Conditions | COD kg $O_2$/T |
|---|---|---|---|
| (a) C | 5% $Cl_2$ | 3% Pulp Density 20° C. 70 Min. | 32.0 |
| E | 2% NaOH | 10% Pulp Density 60° C. 90 Min. | 34.1 |
| H | 0.8% NaOCl 40° C. 120 Min. | 10% Pulp Density | 3.2 |
| H | 0.5% NaOCl 40° C. 150 Min. | 10% Pulp Density | 0.9Σ70.2 |
| (b) O/P acid | 0.5% $O_2$/ 1% $H_2O_2$, | 12% Pulp Density 90° C. 60 Min. pH 1.5 | 26.8 |
| H | 2.0% NaOCl | 10% Pulp Density 45° C. 120 Min. | 32.0 |
| H | 1.0% NaOCl | 10% Pulp Density 40° C. 150 Min. | 11.1Σ69.9 |

The kappa number was lowered to 8.3 by the O/P step.

The values for the final white ($R_{457}$) is very close together with 88.6(a) and 89.2(b). Likewise, the strength differs only very little. At 30 SR after (a) there was obtained 4.8 km breaking length and 820 mNm/m tear after (b) 4.7 km length at break and 830 mNm/tear.

Since the COD value is determinative for the duty to be paid for the waste water, variant (b) proves to be the more economical. It makes possible the reduction of the waste water load through vaporization and burning of the amount of waste water formed in the acid O/P step, in this case about 26.8 kg $O_2$/t COD (t is measured in metric tons).

The remaining 43.1 kg $O_2$/t COD has a $BOD_5$ value (biological oxygen demand) of 32.3 kg $O_2$/t are thus broken down 74.9%.

In contrast for sequence (a) with 70.2 kg $O_2$/t COD, there results a $BOD_5$ value of 21.2 kg $O_2$/t, which corresponds to a degree of breakdown of only 30%.

However, there can also be connected to the O/P step other bleaching sequences such as, e.g., CD-H-D, H-H-D, or PD or H-PD, P-H, H-H.

There are set forth in Table 3 the results of a further variant.

TABLE 3

Bleaching of Spruce Sulfite Cellulose (Kappa 20.0)

| Bleaching Sequence | Chemicals | Conditions | Final $R_{457}$ | COD kg $O_2$/t |
|---|---|---|---|---|
| (a) C | 6.0% $Cl_2$ | 3% Pulp Density 20° C. 60 Min. | | 36.3 |
| E | 2.0% NaOH | 10% Pulp Density 70° C. 90 Min. | | 37.0 |
| H | 1.0% NaOCl | 10% Pulp Density 40° C. 120 Min. | | 8.4 |
| D | 0.3% $ClO_2$ | 12% Pulp Density 65° C. 180 Min. | 90.8 | 3.3Σ85.0 |

TABLE 3-continued

Bleaching of Spruce Sulfite Cellulose (Kappa 20.0)

| Bleaching Sequence | Chemicals | Conditions | Final $R_{457}$ | COD kg $O_2$/t |
|---|---|---|---|---|
| (b) O/P acid | 1% $H_2O_2$, 0.5% $O_2$ | 12% Pulp Density 95° C. 60 Min. | | 40.1 |
| H | 2.8% NaOCl, 0.6% NaOH | 10% Pulp Density 45° C. 90 Min. | | 23.2 |
| P 0.4% NaOH | 0.5% $H_2O_2$, 65° C. 120 Min. | 10% Pulp Density | | 15.8 |
| D | 0.3% $ClO_2$ | 12% Pulp Density 65° C. 180 Min. | 90.6 | 3.4Σ82.5 |

The delignification in the O/P step is nearly 50%, there was ascertained a Kappa number of 10.5. The strengths of the cellulose produced with the two sequences differs only to a trifling extent; at 30 SR there was ascertained for (a) and (b) 6.2 respectively 6.0 km breaking length was well as 1420 respectively 1480 mNm/m tear.

By the return of the waste water from the acid O/P step into the chemical preparation of the disintegration, the waste water load expressed as COD drops to about 48.6%, while the waste water resulting from bleaching sequence (a) cannot be reduced in this simple manner.

TABLE 4

Bleaching of Magnesium Sulfite Spruce Cellulose (Kappa 22.3)

| Bleaching Sequence | Chemicals | Conditions | Final White $R_{457}$ | Kappa | COD kg $O_2$/ (metric ton) |
|---|---|---|---|---|---|
| (a) C | 6.3% $Cl_2$ | 3% Pulp Density 20° C. 60 Min. | | | 38.3 |
| E | 2.0% NaOH | 10% Pulp Density 70° C. 90 Min. | | 3.4 | 37.8 |
| H | 1.2% NaOCl | 10% Pulp Density 40° C. 120 Min. | | | 9.5 |
| D | 0.3% $ClO_2$ | 12% Pulp Density 65° C. 180 Min. | 91.2 | <1 | 2.8Σ88.4 |
| (b) $O_{MgO}$ | 1.0% $O_2$ 2.0% MgO | 25% Pulp Density 120° C. 120 Min. | | 12.8 | 28.1 |
| O/P acid | 0.5% $O_2$ 1.0% $H_2O_2$ 1.0% $H_2SO_4$ | 14% Pulp Density 95° C. 60 Min. | | 8.2 | 28.7 |
| H | 1.5% NaOCl 0.15% Sulfaminic acid | 10% Pulp Density 50° C. 60 Min. | | | 19.8 |
| D | 0.3% $ClO_2$ | 10% Pulp Density 65° C. 120 Min. | | | 7.0 |
| P | 0.5% $H_2O_2$ 0.5% NaOH | 10% Pulp Density 60° C. 120 Min. | 92.1 | <1 | 4.5Σ88.1 |

Table 4 illustrates the advantages of a combination according to the process of the invention with the oxygen delignification in the presence of MgO, which is the state of the art. The delignification with oxygen in the presence of MgO leads to a lignin breakdown to about 60% of the starting value. Through the subsequent acid treatment with oxygen and hydrogen peroxide, the Kappa number is lowered to 8.2 corresponding to <40% of the starting value. Since both the waste water of the $O_{MgO}$– and the O/P step can be supplied to the vaporization, a reduction of COD in the waste water of over 60% is possible.

A further preferred illustrative form consists of the combination with the delignification in the presence of magnesium oxide, hydrogen peroxide, and oxygen in the alkaline range. The following example is directed to delignification and bleaching of a beech sulfite-cellulose with a Kappa number of 16.3.

Step 1:

O/P in the presence of magnesium oxide

Chemicals: 1.4% $H_2O_2$, 1% MgO, 0.5% $O_2$

Conditions: 14% Pulp density, 98° C., 90 Min.

This treatment reduces the Kappa number around 6.5 units to 9.8. The residual peroxide is 0.78%. By addition of further oxygen and excess sulfuric acid without intermediate washing, there is added an acic O/P treatment:

Step 2:

O/P in the presence of acid

Chemicals: 0.5% $O_2$, 2% $H_2SO_4$

Conditions: 12% Pulp density, 95° C., 60 Min.

In this step, the pH at the end is 1.8, the residual peroxide content is 0.12%, and the Kappa number is 5.1. Through an intensive washing after this step, there is attainable a waste water load of 52.4 kg $O_2$/t COD. The final bleaching of the cellulose with two hypochlorite steps is possible:

Conditions: 10% Pulp density, 50° C., 120 Min.

Chemicals: $H_1$-step, 1.5% NaOCl, 0.15% sulfamic acid $H_2$-step, 0.5% NaOCl, 0.05% sulfamic acid From the subsequent bleaching, there results a loading of the waste water of 21.1 kg $O_2$/t COD. The final whiteness content is 90.8% remission ($R_{457}$).

What is claimed is:

1. A process for the delignification and bleaching of cellulose comprising the step treating lignin containing cellulose simultaneously with oxygen and hydrogen peroxide, wherein there is employed and oxygen pressure of 0.03 to 0.5 MPa, an oxygen concentration of 0.1 to 5.0 wt.%, a hydrogen peroxide concentration of 0.1 to 3.0 wt.%, in each case based on the bone dry weight of the cellulose, a pulp density of 2 to 30% in the pH range of 1 to 4 and a temperature of 60° to 120° C.

2. A process according to claim 1 comprising partially delignifying the cellulose in a preliminary alkaline treatment step with oxygen in the presence of MgO prior to the simultaneous treatment with oxygen and hydrogen peroxide under acid conditions.

3. A process according to claim 1 comprising partially delignifying the cellulose in a preliminary alkaline treatment step with oxygen in the presence of MgO prior to the simultaneous treatment with oxygen and hydrogen peroxide under acid conditions.

4. A process according to claim 2 including the use of hydrogen peroxide in the alkaline treatment with oxygen and MgO.

5. A process according to claim 4 including the step of adding further oxygen and sulfuric acid to the pulp mixture containing residual hydrogen peroxide from the alkaline preliminary step to provide the oxyge, hydrogen peroxide, and acid conditions for the acid delignification and bleaching step.

6. A process according to claim 4 comprising going directly from the alkaline hydrogen peroxide-oxygen treatment to the subsequent hydrogen peroxide-oxygen treatment at a pH within the range of 1 to 4 without an intermediate washing step.

7. A process according to claim 4 carried out without addition of further hydrogen peroxide in the acid treatment step.

8. A process according to claim 5 wherein the sole materials added to the pulp mixture containing residue hydrogen peroxide from the alkaline preliminary step are oxygen and sulfuric acid.

9. A process according to claim 8 wherein there is employed sulfite cellulose.

10. A process according to claim 7 wherein the final bleaching consists of $C_D$-H-D, H-H-D, P-D, H-P-D, PH, H-H, or H-D-P-sequence.

11. A process according to claim 6 wherein the final bleaching consists of $C_D$-H-D, H-H-D, P-D, H-P-D, PH, H-H, or H-D-P-sequence.

12. A process according to claim 8 wherein the final bleaching consists of $C_D$-H-D, H-H-D, P-D, H-P-D, PH, H-H, or H-D-P-sequence.

13. A process according to claim 2 wherein the final bleaching consists of $C_D$-H-D, H-H-D, P-D, H-P-D, PH, H-H, or H-D-P-sequence.

14. A process according to claim 1 wherein the final bleaching consists of $C_D$-H-D, H-H-D, P-D, H-P-D, PH, H-H, or H-D-P-sequence.

15. A process according to claim 10 wherein there is employed sulfite cellulose.

16. A process according to claim 7 wherein there is employed sulfite cellulose.

17. A process according to claim 6 wherein there is employed sulfite cellulose.

18. A process according to claim 2 wherein there is employed sulfite cellulose.

19. A process according to claim 2 wherein there is employed sulfite cellulose.

20. A process according to claim 15 wherein the sulfite cellulose is produced using calcium or magnesium sulfite.

21. A process according to claim 1 wherein the sole materials added to the cellulose in treating the lignin containing cellulose in the step of treating the cellulose with oxygen and hydrogen peroxide at a pH in the range of 1 to 4 are the oxygen and hydrogen peroxide.

22. A process according to claim 21 wherein there is employed sulfite cellulose.

* * * * *